United States Patent [19]

Kawano et al.

[11] Patent Number: 4,952,989

[45] Date of Patent: Aug. 28, 1990

[54] PHOTORECEPTOR ATTACHMENT DEVICE FOR AN ELECTROPHOTOGRAPHIC COPYING MACHINE

[75] Inventors: Tadaaki Kawano, Nara; Susumu Murakami, Osaka; Fukusaburo Ito, Nara; Hideaki Hagihara, Moriguchi; Takashi Miyaji, Yamatokoriyama; Masaru Nishijima, Hirakata, all of Japan

[73] Assignee: Sharp Kabushiki Kaisha, Osaka, Japan

[21] Appl. No.: 273,672

[22] Filed: Nov. 18, 1988

[63] Continuation of Ser. No. 180, 632, Apr. 4, 1988, abandoned, which is a continuation of Ser. No. 70,103, Jun. 29, 1987, abandoned, which is a continuation of Ser. No. 852,229, Apr. 15, 1986, abandoned.

[30] Foreign Application Priority Data

| | | | |
|---|---|---|---|
| Apr. 16, 1985 | [JP] | Japan | 60-82968 |
| Apr. 16, 1985 | [JP] | Japan | 60-82969 |
| Apr. 16, 1985 | [JP] | Japan | 60-82970 |
| Apr. 16, 1985 | [JP] | Japan | 60-82971 |
| Apr. 16, 1985 | [JP] | Japan | 60-82972 |
| Apr. 16, 1985 | [JP] | Japan | 60-82973 |
| Apr. 16, 1985 | [JP] | Japan | 60-57931 |

[51] Int. Cl.[5] ..... G03G 15/00; G03G 21/00

[52] U.S. Cl. ..... 355/210; 355/245

[58] Field of Search ..... 355/3 R, 3 DR, 3 TR, 355/3 SH, 14 SH, 210, 211, 212, 213, 245

[56] References Cited

U.S. PATENT DOCUMENTS

| | | | |
|---|---|---|---|
| 3,604,797 | 9/1971 | Szczesniak | 355/212 |
| 3,736,053 | 5/1973 | Shreeve et al. | 355/3 DR |
| 3,976,371 | 8/1976 | Moser et al. | 355/3 DD |
| 3,998,537 | 12/1976 | Smith et al. | 355/3 DD |
| 4,076,409 | 2/1978 | Hamaguchi et al. | 355/212 |
| 4,114,998 | 9/1978 | Shimizu et al. | 355/3 DR |
| 4,116,556 | 9/1978 | Tanaka et al. | 355/3 SH |
| 4,131,359 | 12/1978 | Honda | 355/15 |
| 4,386,841 | 6/1983 | Wakao et al. | 355/3 DR |
| 4,540,268 | 9/1985 | Toyono et al. | 355/3 DR X |
| 4,563,074 | 1/1986 | Tsutsui et al. | 355/3 DR X |
| 4,609,276 | 9/1986 | Mitzutani | 355/3 DR X |

FOREIGN PATENT DOCUMENTS

| | | | |
|---|---|---|---|
| 57-141674 | 9/1982 | Japan | 355/3 DR |
| 59-195250 | 11/1984 | Japan | 355/3 DR |

*Primary Examiner*—Fred L. Braun

*Attorney, Agent, or Firm*—Flehr, Hohbach, Test, Albritton & Herbert

[57] ABSTRACT

A photoreceptor of an electrophotographic copying machine is rotatably supported by a mounting member. The mounting member is rotatably supported by a supporting member which can slide out of the housing of the copying machine. The supporting member also supports a developing station. When the supporting member is pulled out of the housing, the developing station can be displaced on the supporting member away from the photoreceptor and the mounting member can be rotated so as to expose the photoreceptor such that its surface becomes accessible from outside.

1 Claim, 8 Drawing Sheets

Figure 2:
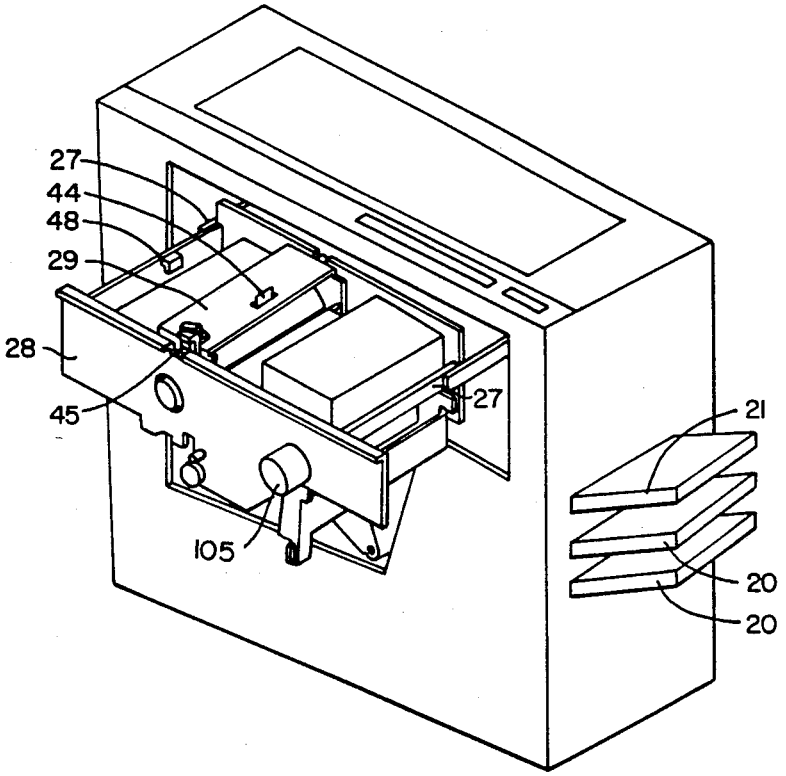

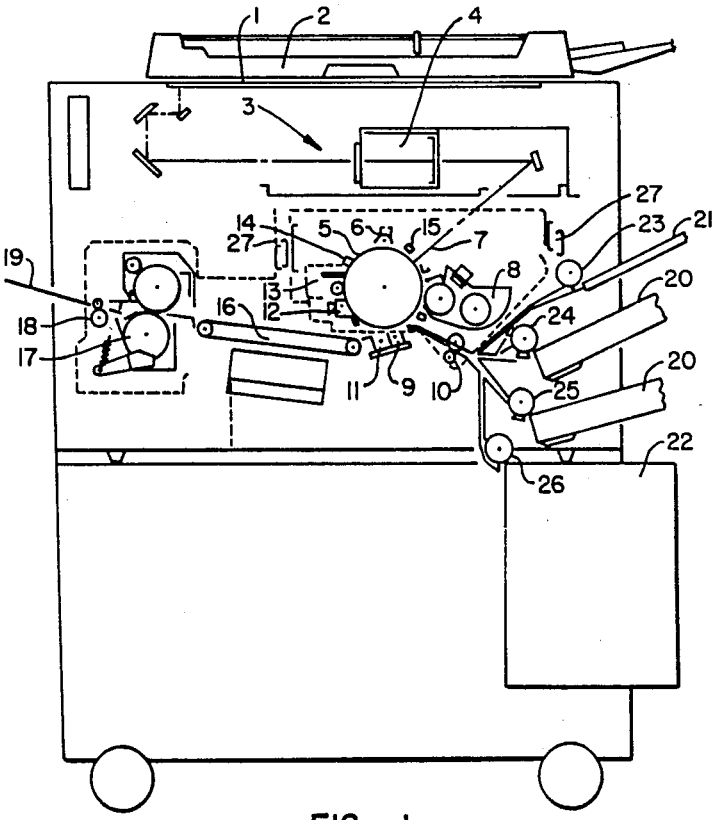
FIG.__1.
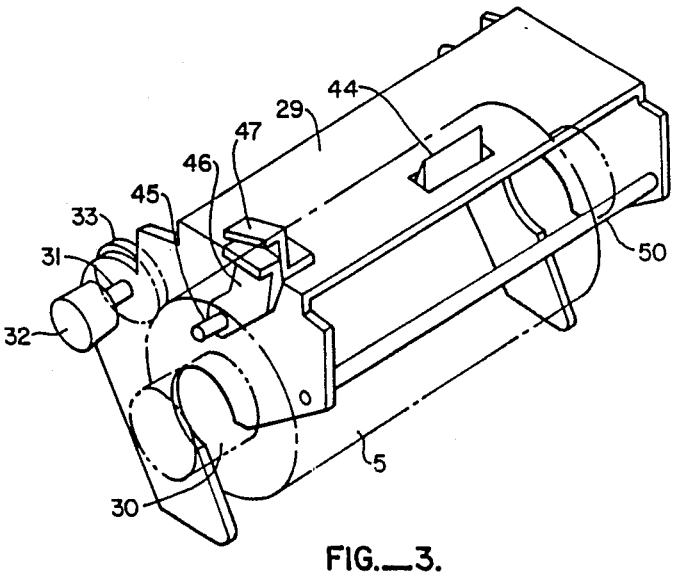
FIG.__3.

PHOTORECEPTOR ATTACHMENT DEVICE FOR AN ELECTROPHOTOGRAPHIC COPYING MACHINE

This is a continuation of application Ser. No. 180,632 filed Apr. 4, 1988, now abandoned, which is a continuation of application Ser. No. 070,103 filed June 29, 1987, now abandoned, which is a continuation of application Ser. No. 852,229 filed Apr. 15, 1986, now abandoned.

This invention relates to a photoreceptor attachment device for an electrophotographic copying machine and more particularly to an electrophotographic copying machine with an improved design including a single supporting member supporting both its photoreceptor and a developing station such that they can be pulled out easily together.

An electrophotographic copying machine includes a photoreceptor having a photosensitive layer which is typically in a cylindrical form and is commonly called a drum. Various components for forming an image are disposed adjacent to and surrounding its circumferential surface and an electrostatic latent image is formed thereon through charging and irradiation. Such a latent image is developed at a developing station and the developed image called a toner image is transferred onto an image-receiving member (or simply a copy paper) which is brought in a convenient manner. After the image is transferred away, a portion of the image (toner) still remains on the photoreceptor, which is subsequently made ready for forming another image thereon by having this toner removed. A cleaning means is provided opposite to the photoreceptor for the purpose of removing the toner left thereon.

The photoreceptor body for forming an image thereon is nearly at the center of the copying machine and rotatably supported by an axis, and is generally adapted to be pulled out of the housing in the direction of the axis when it is replaced or cleaned. When a photoreceptor body is installed back in its position after it is exchanged or cleaned, however, there is the danger of making its surface dirty by touching it by hand. Moreover, components such as the developing station and the cleaning means which must be positioned accurately with respect to the photoreceptor are also made removable so that developing liquid and toner can be replenished, etc. but it has been difficult to adjust their positional relationships.

In view of the aforementioned difficulty associated with individually removing components inside the copier housing for cleaning or exchanging, an idea has been disclosed in U.S. Pat. No. 3,985,436 issued Oct. 12, 1976, according to which some of the components disposed opposite to the photoreceptor body are unitized and this unitized member is made entirely removable. For example, the photoreceptor, the developing station and the cleaning means may be mounted on a single supporting member which is slidably disposed inside the copier housing so that the relative positions of these components need not be adjusted when they are installed again. According to this design, however, it is not possible to exchange only the photoreceptor, for example, without also exchanging the other components mounted on the same supporting member. This is not an economical way of operating a copying machine.

There are other disadvantages associated with a copying machine of this design. When the developing liquid for the developing station is replaced, the entire assembly including the photoreceptor mounted on the same supporting member must be exchanged. Even if the design allowed the developing liquid to be replaced, a new liquid would have to be stirred and transported. If the developing station is firmly secured to this supporting member, however, the magnetic brush, for example, may keep brushing the same surface area of the photoreceptor with the motion of the stirrer or the motion of the developer roller, inflicting injuries to the surface of the photoreceptor or applying too much toner at the same place thereon. This would tend to damage the photoreceptor and prevent formation of clear images. Since it is not possible to replace only the developing station without also replacing some other components, furthermore, a unit with a separate photoreceptor, a cleaning means, etc. may have to be provided for each toner color when development is effected with a toner of a color other than black. This would not only complicate the operation for exchanging the units but also make it necessary to reserve areas for disposing unused units.

When there is a jamming of copy paper inside the machine, furthermore, it is usually not a simple matter to remove the jammed paper even if the unitized assembly including the photoreceptor, the developing station, etc. is pulled out. Since the paper is transported inside the machine along a certain fixed route, this route must be opened up in such an event.

If the aforementioned unitized assembly is pulled out, however, the paper jamming the route will be torn and the next copying operation may be started with a portion of the torn paper still remaining in the original position. For this reason, it is preferable to be able to open up the paper route for removing any jammed paper.

In order thus to open up the paper route, some copying machines have been so designed that the housing is separable into two parts along the paper transporting route. If the housing is not so designed, however, it is necessary to be able to open up the transporting route in some other way. For example, the route to the image transferring position opposite to the photoreceptor where images are transferred and the outward route from this transferring position may be made openable individually. In such a case, the operation for opening up the entire paper transporting route is troublesome and the user is likely to restart the copying operation with one of the paper transporting routes inadvertently left open. Moreover, if the jamming occurs while the paper is still firmly in contact with the photoreceptor, it is likely to make the photoreceptor surface dirty or damaged when the paper is removed by hand.

It is therefore an object of the present invention to provide a photoreceptor attachment device for an electrophotographic copying machine such that the photoreceptor and some of the components opposite to it form a removable unitized assembly.

It is another object of the present invention to provide an electrophotographic copying machine of the type described above of which only a component needing replacement can be removed easily so that, for example, the photoreceptor can be easily replaced and/or cleaned.

It is still another object of the present invention to provide such an electrophotographic copying machine of the type described above with which the developing liquid can be stirred and transferred to the developing roller while the copying machine is stopped and in particular with which the developing liquid can be stirred continuously even when the developing station is separated from the photoreceptor.

It is a further object of the present invention to provide an electrophotographic copying machine of the type described above of which the developing station can be replaced and its relative position with respect to the photoreceptor can be reliably adjusted.

It is a still further object of the present invention to provide an apparatus for transporting copy paper to an image transferring position where images on the photoreceptor are transferred such that jammed paper and in particular paper in contact with the photoreceptor can be efficiently disposed of.

The above and other objects of the present invention are achieved by providing an electrophotographic copying machine with an improved design such that its photoreceptor and developing station are supported by a single supporting frame which is slidably removable in the direction of the axis of the photoreceptor. The route through which copying paper is transported to a position where image transfer takes place from the photoreceptor to the paper and from this position to the exterior of the copying machine after the transferred image is fixed, is openable such that jammed paper can be removed easily. In order to prevent jamming of paper, the supporting frame is removable only when the paper route is opened.

Figure 4:
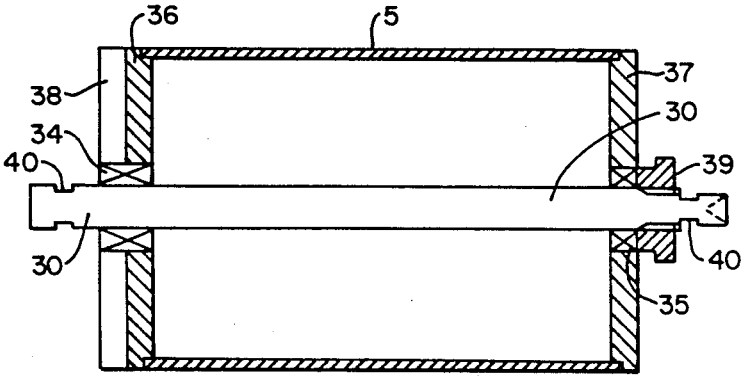
Figure 5:
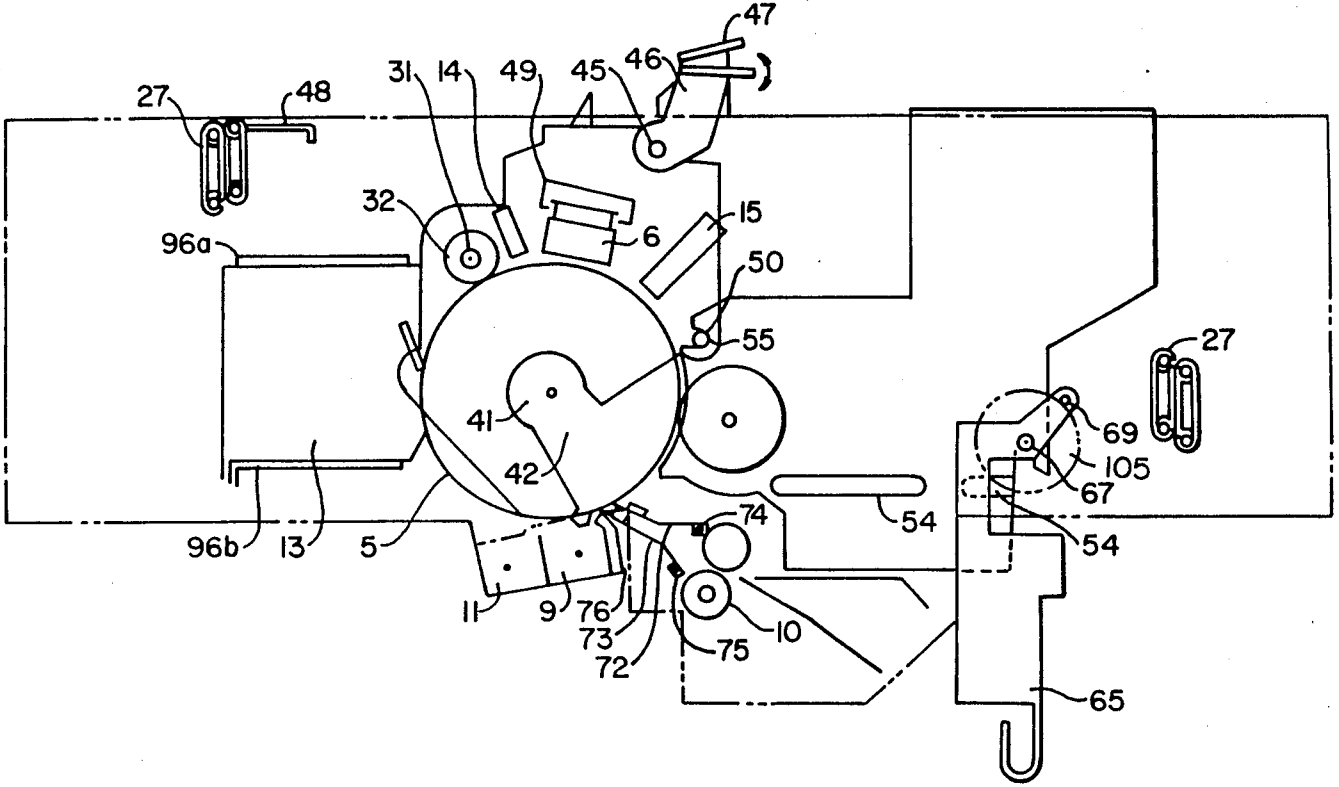
Figure 6:
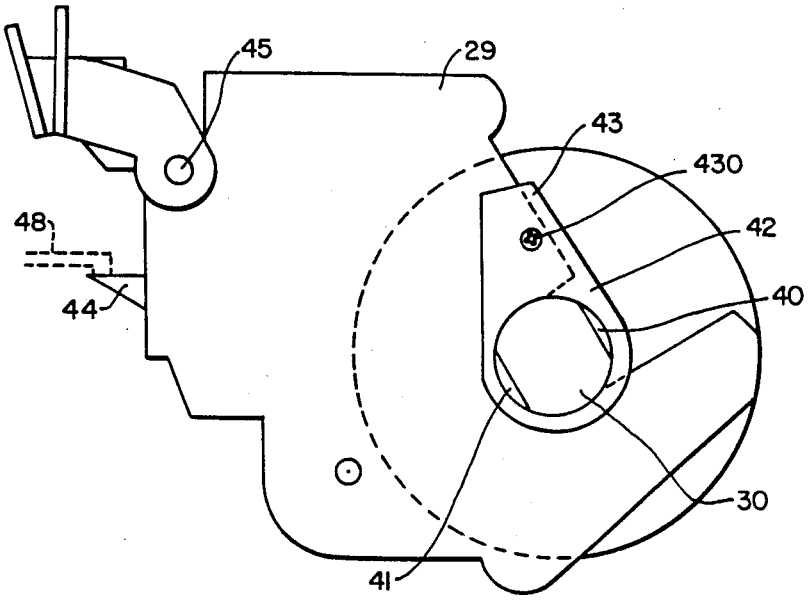
Figure 7:
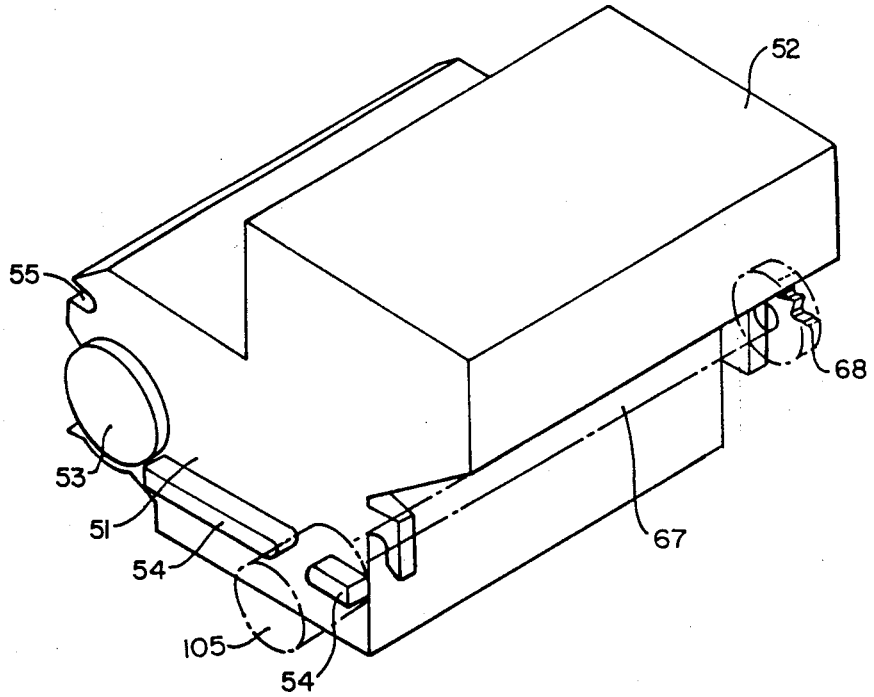
Figure 8:
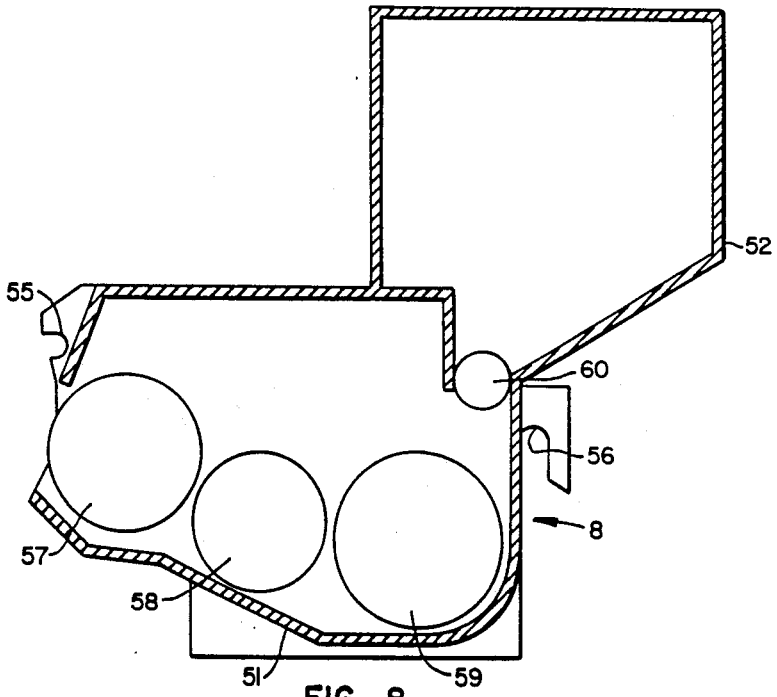
Figure 9:
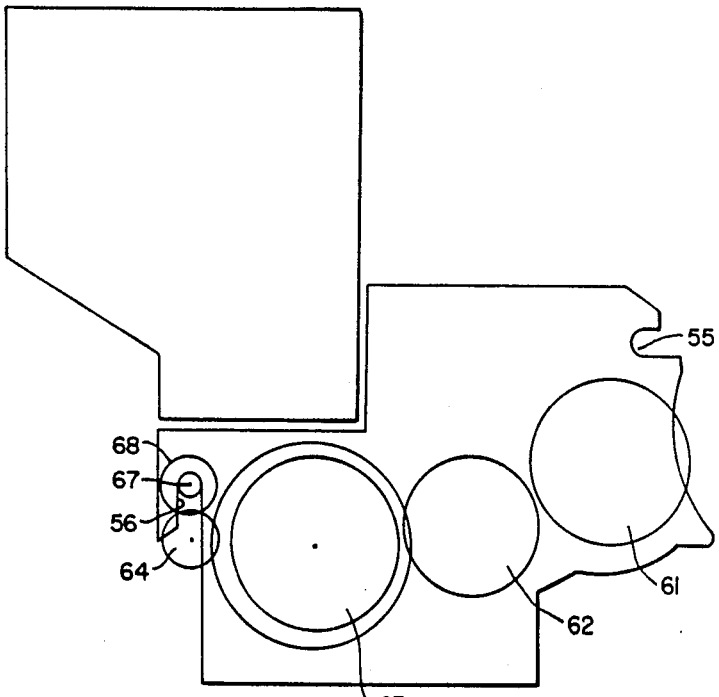
Figure 10:
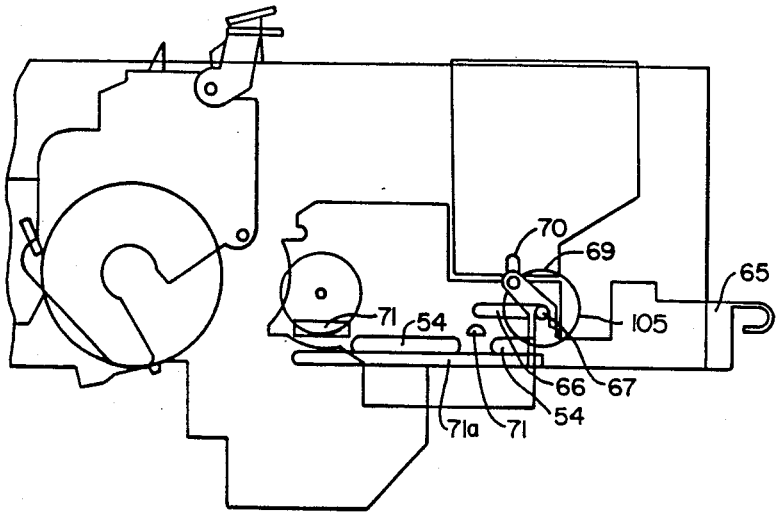
Figure 11:
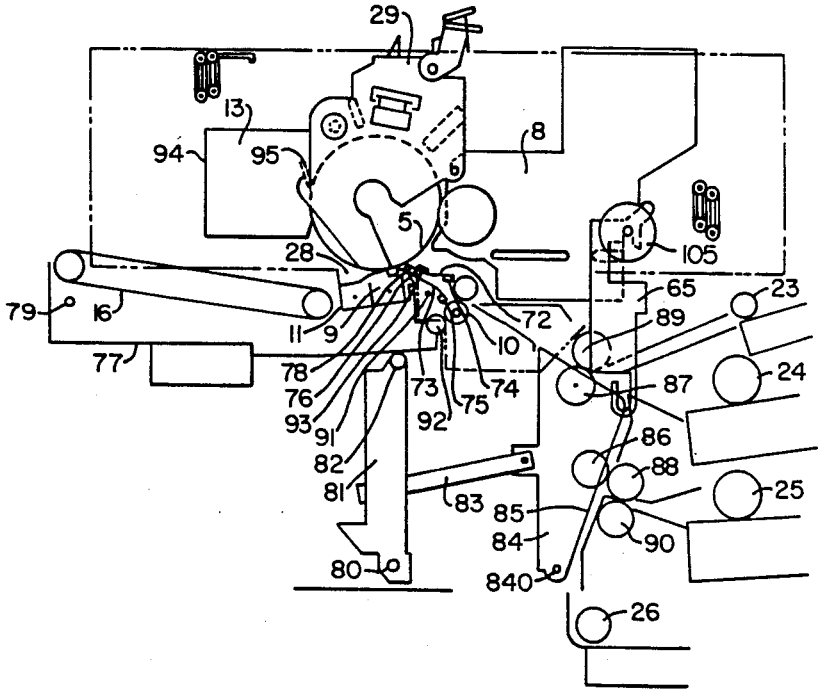
Figure 12:
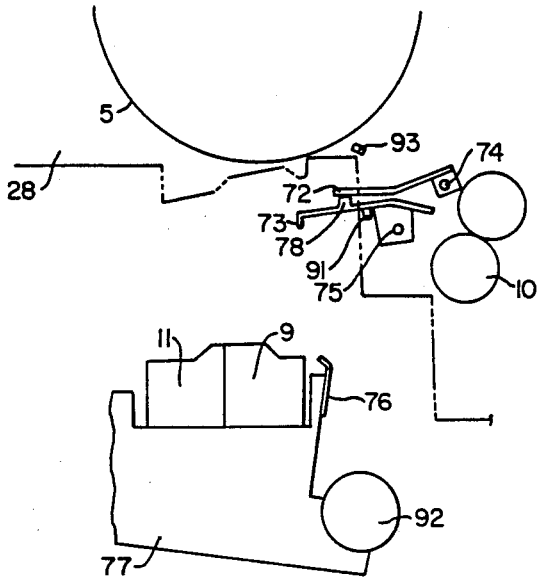
Figure 13:
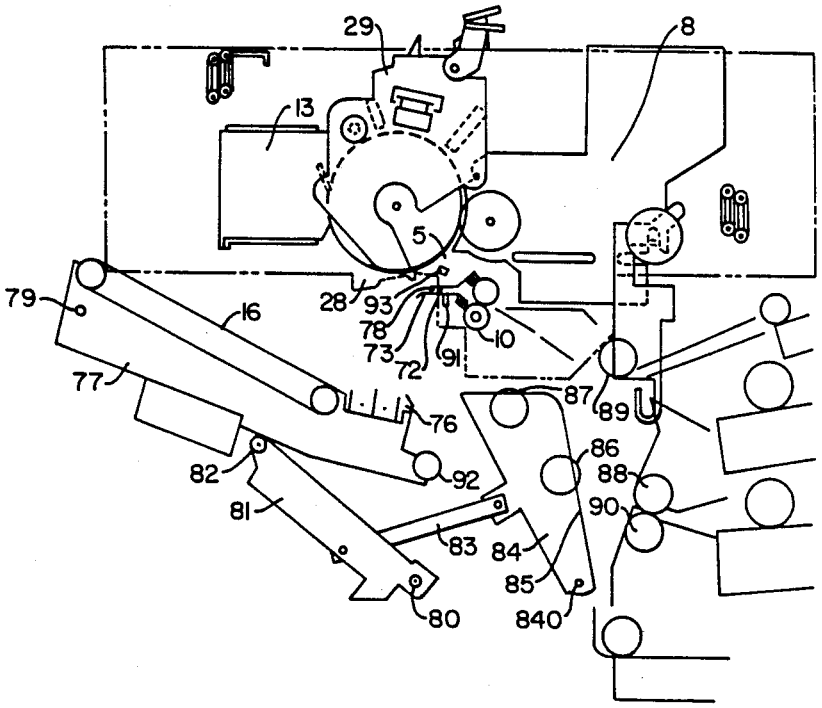
Figure 14:
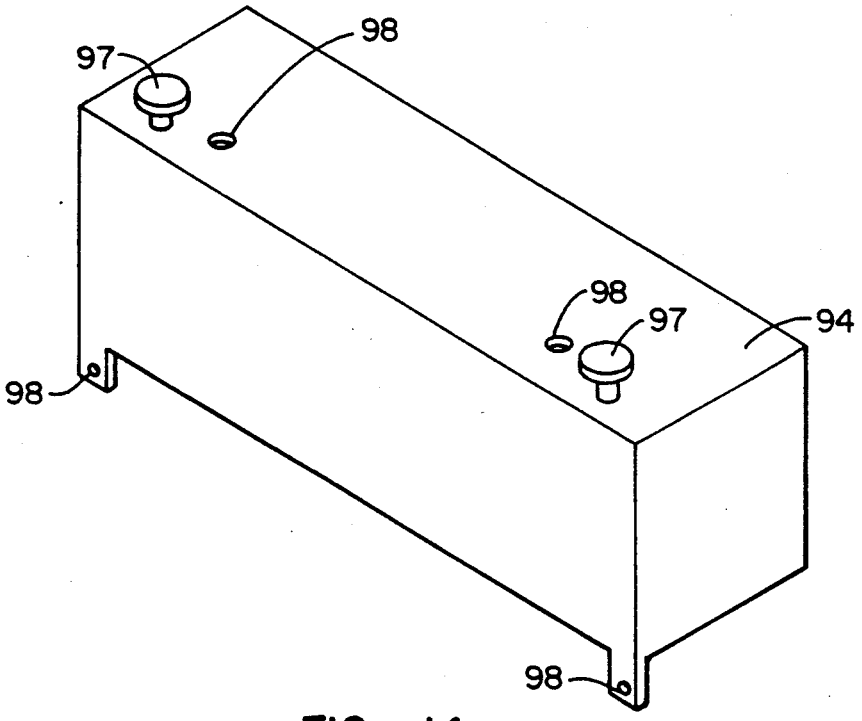
Figure 15:
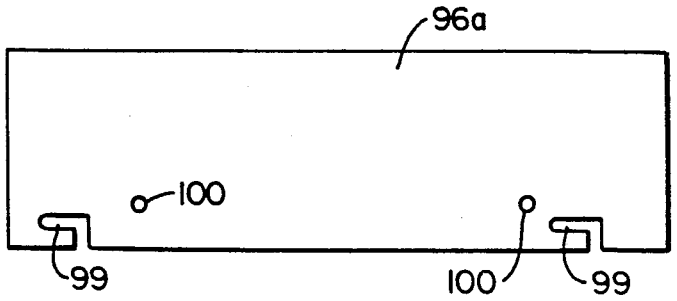

The accompanying drawings, which are incorporated in and form a part of the specification, illustrate embodiments of the present invention and, together with the description, serve to explain the principles of the invention. In the drawings:

FIG. 1 is a sectional view of an electrophotographic copying machine embodying the present invention, FIG. 2 is a perspective view of a processing unit embodying the present invention when it is pulled out of the housing of the copying machine of FIG. 1, FIG. 3 is a perspective view of components which support the photoreceptor of the copying machine of FIG. 1, FIG. 4 is a cross-sectional view of the photoreceptor, FIG. 5 is an entire side view of the processing unit embodying the present invention, FIG. 6 is a side view of the photoreceptor in the "open position", FIG. 7 is a perspective external view of the developing station, FIG. 8 is a sectional view showing the interior of the developing station, FIG. 9 is a side view showing the driving system for the developing station, FIG. 10 is a side view showing how the developing station is removed, FIG. 11 is a side view showing the relationship between the processing unit of the copying machine of FIG. 1 and the paper route therethrough, FIG. 12 is an enlarged side view of the paper route through the processing unit of FIG. 11 when it is opened, FIG. 13 is a side view of the paper route of FIG. 11 when it is opened, FIG. 14 is a perspective external view of the housing of the cleaner unit, and FIG. 15 is a plan view showing how the cleaning unit is secured.

Reference being made to FIG. 1 which is a sectional view of an electrophotographic copying machine embodying the present invention, numeral 1 indicates a document table made of a transparent glass plate for placing thereon an original document or documents to be copied, numeral 2 indicates an automatic document feeder disposed above the table 1, numeral 3 indicates an optical system which includes a lens 4 for forming an image on the surface of a photoreceptor with the reflected beams from a document placed on the document table 1, numeral 5 indicates a photoreceptor in the shape of a drum having a photosensitive layer comprising arsenic selenide ($As_2Se_3$), numeral 6 indicates a principal corona discharger serving to uniformly charge the photoreceptor 5 with predetermined polarity, numeral 7 indicates an irradiating position on the photoreceptor 5 by the optical system 3, numeral 8 indicates a developing station serving to develop electrostatic latent images formed on the photoreceptor 5 with a colored toner, numeral 9 indicates a transfer corona discharger serving to transfer the toner image developed on the photoreceptor onto a copy paper which is delivered into proper position through synchronization rollers 10, numeral 11 indicates an AC corona discharger serving to electrostatically separate a copy paper from the photoreceptor 5, numeral 12 indicates another AC corona discharger serving to remove electric charges left on the photoreceptor 5, numeral 13 indicates a cleaner unit serving to remove the toner left on the photoreceptor 5, numeral 14 indicates a charge removing lamp serving to uniformize the surface potential of the photoreceptor 5 before another image is formed thereon, and numeral 15 indicates an eraser lamp serving to remove charges in the unwanted areas on the photoreceptor 5 after the latter is uniformly charged.

The copy paper, after an image is transferred thereonto and the electrostatic force attracting it to the photoreceptor 5 is weakened by an AC corona discharge, separate itself from the photoreceptor 5 by its own weight. The separated paper is removed by a conveyor belt 16 disposed between the separating position and fixing rollers 17. The conveyor belt 16 is provided with an air suction means for pulling the back surface of the paper, or the surface opposite to the side supporting the toner image, towards the belt such that the paper can be transported to the fixing rollers 17 without disturbing the toner image. The fixing rollers 17 are, for example, heat rollers with the surface which comes into contact with the toner image heated to an appropriate temperature for the purpose of fixing, and the toner image on the paper thus transported is thermally fixed thereby. Discharge rollers 18 are disposed at the paper ejecting part of the fixing rollers 17 such that the paper advanced through the fixing rollers 17 are discharged into a discharge tray 19 through the discharge rollers 18.

Copy papers are initially placed in cassettes 20 which are removable from the copier housing, on the feed table 21 or on a feed tray 22 and are sequentially delivered to the synchronization rollers 10 through selective operation of feed rollers 23, 24, 25 and 26. The paper thus transported to the synchronization rollers 10 is further transported to an image transferring position by the operation of the synchronization rollers 10 in synchronism with the rotation of the photoreceptor 5. In other words, the synchronization rollers 10 are controlled in synchronism with the rotation of the photoreceptor 5 such that the front edge of the image forming area on the photoreceptor 5 will coincide with the front edge of the incoming copy paper.

The photoreceptor 5 is mounted inside the copying machine of FIG. 1 in such a way that it can be pulled out in the direction of its axis. Reference being made next to FIG. 2, the photoreceptor 5 is attached through attaching means 29 to a supporting frame 28 which is slidably mounted to the housing of the copying machine to support the processing unit. Thus, there are image forming means disposed opposite to the photoreceptor 5 in addition to the photoreceptor 5 itself mounted on the supporting frame 28. Among the image forming means mounted on this supporting frame 28 are the principal corona discharger 6, the developing station 8, the cleaner unit 13, the charge removing lamp 14 and the eraser lamp 15. Since the AC corona discharger 11 for separating papers and the charge removing lamp 14 are available, it is not essential to the formation of images whether of not the AC corona discharger 12 for removing charges is present.

As shown in FIG. 3, the photoreceptor 5 is rotatably supported by an axis 30 which is secured to the attaching means 29. The attaching means 29, which was also shown in FIG. 2, is rotatably supported by the supporting frame 28 through an axis 31. One end of the axis 31 penetrates the supporting frame 28 and is capped by a manual knob 32 for rotating the photoreceptor 5. The other end of the axis 31 penetrates the supporting frame 28 and is attached to a power transmission means (not shown) which is engaged to a means mounted on the housing of the copying machine for transmitting driving power. The axis 30 is further provided with a gear 33 for causing the photoreceptor 5 to rotate.

As shown further in FIG. 4, the photoreceptor 5 is supported between two flanges 36 and 37 mounted on the axis 30 through bearings 34 and 35. A gear 38 for rotating the photoreceptor 5 is attached to the bearing 34 on the side of the flange 36 and is engaged with the gear 33. Thus, the photoreceptor 5 is rotated through the gears 33 and 38 when the knob 32 is turned or by a driving force transmitted from the main part of the copying machine. The flange 36, and hence the bearing 34, is affixed to the axis 30 at the axial position shown in FIG. 4 but the flange 37 is mounted slidably thereon along the axis 30. A securing member 39 for securing the photoreceptor 5 is screwed onto the axis 30 corresponding to the flange 37. The photoreceptor 5 becomes tightly secured between the flanges 36 and 37 if the securing member 39 is fastened to the left (with reference to FIG. 4). The flange 37 can be released from the axis 30 by removing the securing member 39. This is how the photoreceptor 5 secured between the flanges 36 and 37 can be removed, for example, to be replaced by a new one.

At each end, the central axis 30 of the photoreceptor 5 is provided with D-shaped cuts 40 by means of which the photoreceptor 5 can be attached to the attaching means 29. As shown in FIGS. 5 and 6, the attaching means 29 is provided with an insertion entrance 42 leading to the opening 41 for holding the axis 30, the insertion entrance 42 being shaped to match these D-shaped cuts. When the axis 30 holding the photoreceptor 5 is attached to or removed from the attaching means 29, the attachment means 29 is rotated in the counter-clockwise direction with respect to the supporting frame 28, the insertion entrance 42 leading to the axis-holding opening 41 is moved to an upper position, the D-shaped cuts 40 on the axis 30 are matched with the orientation of the insertion entrance 42, and the axis is pulled out or pushed in. If the axis 30 is rotated in the counter-clockwise direction at this time, the D-shaped cuts 40 become disengaged from the insertion entrance 42 as shown in FIG. 6 and the photoreceptor 5 is prevented from falling out with the axis 30 held in the opening 41. For this purpose, a lever 43 for turning the axis 30 is provided. As shown in FIG. 6, the lever 43 is secured to the attaching means 29 by a screw means 430 and the photoreceptor 5 is maintained at the position as shown.

An engaging member 44 is provided retractably to the attaching means 29 in order to keep the attaching means 29 in the "open position" (the condition depicted in FIG. 6). This engaging member 44 is attached to an axis 45 rotatably secured to the attaching means 29 such that it can be retracted when the axis 45 is rotated. A lever 46 is attached to one end of the axis 45 as shown in FIGS. 3 and 5. A handle 47 is provided to the attaching means 29 corresponding to this lever 46 such that the axis 45 can be turned around by grabbing the lever 46 and the handle 47 to press them together and the engaging means 44 becomes retracted. The supporting frame 28, on the other hand, is provided with an engaging piece 48 corresponding to this engaging member 44 as shown in FIG. 2. Thus, if the attaching means 29 is rotated with respect to the supporting frame 28 and the lever 46 is turned as shown in FIG. 6, the engaging member 44 becomes engaged with the engaging piece 48 and the attaching means 29 can be maintained at the position shown.

Since the photoreceptor 5 becomes exposed in the "open position" shown in FIG. 6, the surface of the photoreceptor 5 becomes easily polishable. In order to polish the entire surface, the knob 32 might be rotated manually. Thus, since the surface of the photoreceptor can now be cleaned without removing the photoreceptor 5 itself but while it is kept in the normal condition, the surface is less likely to become dirty and the cleaning can be effected more easily and thoroughly. The photosensitive layer, for example, of $As_2Se_3$ on the photoreceptor 5 is about 60 micrometers in thickness over an aluminum surface and a thickness of about 0.2-0.5 micrometers is polished off by each cleaning (polishing).

There are components other than the photoreceptor 5 mounted on the attaching means 29. As shown in FIG. 5, the components mounted on the attaching means 29 include the charge removing lamp 14, a guide member 49 for removably securing the principal corona discharger 6 for uniformly charging the photoreceptor 5 and the eraser lamp 15 for erasing charges where there is no image. A positioning axis 50 for maintaining the positional relationship between the developing station 8 and the photoreceptor 5 is further attached to the attaching means 29.

Next, the developing station 8 for developing electrostatic latent images formed on the surface of the photoreceptor 5 will be described. As shown in FIG. 7, the developing station 8 includes a tank 51 and a toner hopper 52 unistructurally assembled by screw means or the like. A collar 53 is rotatably attached to a side of the tank 51 in order to maintain a fixed distance from the photoreceptor 5. At the side of the tank 51, there are also guide means 54 unistructurally formed for moving the developing station 8 itself in a horizontal direction. A positioning groove 55 is formed on the front surface of the tank 51 corresponding to the aforementioned positioning axis 50 on the attaching means 29 such that the developing station 8 can be reliably positioned by engaging the positioning axis 50 of the attaching means 29 with the positioning groove 55. At the back of the tank 51, there is provided an engaging groove 56 for moving the developing station 8 in another horizontal direction.

Inside the developing station 8, or inside the tank 51, there are a developer roller 57 and stirrer rollers 58 and 59 disposed rotatably as shown in FIG. 8. The developer roller 57 includes a magnet inside a nonmagnetic sleeve such that the developing liquid attracted to the sleeve surface by the magnetic force is transported to a developing position opposite to the photoreceptor 5 when the sleeve is rotated. Electrostatic latent images formed on the photoreceptor 5 are thus developed. The stirrer rollers 58 and 59 are for stirring the toner applied from the toner hopper 52 through the toner supply roller 60 and sending it to the developer roller 57.

As shown in FIG. 9, motion-communicating mean or gears 61, 62 and 63 are attached to the axes of the developer roller 57 and the stirrer rollers 58 and 59, respectively, and are engaged with each other. The gear 63 associated with the stirrer roller 59 is adapted to engage with a gear 64 rotatably mounted at a fixed position on the supporting frame 28 when the developing station 8 is moved to a position away from the aforementioned developing position.

When the supporting frame 28 is pulled out as shown in FIG. 2 and the developing station 8 has been moved to a position away from the developing position, it thus becomes possible to remove it in an upward direction, or to install it from above. For this purpose, a positioning lever 65 is provided to the supporting frame 28 as shown in FIG. 5. An axis 67 penetrates the positioning lever 65 through a horizontally elongate hole 66 as shown in FIG. 10 and a gear 68 is affixed to this axis 67 opposite to the gear 64 on the supporting frame 28 as shown in FIG. 9. The positioning lever 65 is rotatably mounted on an axis 69 as shown in FIGS. 5 and 10. The axis 69 is freely slidable along a vertically elongate hole 70 formed in the supporting frame 28 and is biased to the lowest position as shown in FIG. 10 by means of a biasing means (not shown). Accordingly, the axis 67 moves along the horizontally elongate hole 66 when the positioning lever 65 is rotated. It is this vertically elongate hole 70 perpendicular to the horizontally elongate hole 66 that compensates this horizontal movement.

The aforementioned axis 67 corresponds to the engaging groove 56 of the developing station 8 and becomes engaged with it as shown in FIG. 7 when the developing station 8 is mounted to the supporting frame 28. In other words, when the positioning lever 65 is turned in the counter-clockwise direction and the axis 67 comes to the position shown in FIG. 10, it becomes possible to mount the developing station 8 to the supporting frame 28 and the axis 67 engages with the engaging groove 56.

The supporting frame 28 is further provided with guide members 71 and 71*a* so as to sandwich the guide means 54. When the developing station 8 is mounted, the guide means 54 is supported by the guide member 71*a* on the supporting frame 28 and the developing station 8 is supported by the supporting frame 28. If the lever 65 is rotated then in the clockwise direction, the developing station 8 is moved to the left along the guide members 71 and 71*a*. The collar 53 then touches the side of the photoreceptor 5 and the positioning groove 55 touches the axis 50, thus completing the positioning of the developing station 8. In this situation, not only can the separation between the developing station 8 and the photoreceptor 5 be guaranteed by means of the collar 53 but also the axis 50 and the positioning groove 55 assist in reliably positioning the components such that the separation from the photoreceptor 5 will not change by vibrations, for example, in the vertical direction. The gear 63, etc. become engaged under this condition with the driving force transmitting means on the side of the main body of the copying machine and the developer roller 57, etc. become rotatable.

If the positioning lever 65 is moved to the position shown in FIG. 10, furthermore, the developing station 8 becomes separated from the photoreceptor 5 and releasable from the supporting frame 28. Under this condition, the gear 68 on the axis 67 becomes engaged with the gear 64 on the supporting frame 28 and this gear 64 becomes engaged in turn with the gear 63 of the developing station 8. Thus, the developer roller 57 and the stirrer rollers 58 and 59 inside the tank 51 are caused to rotate by the rotation of the axis 67 and the developing liquid is stirred. A knob 105 is affixed at one end of this axis 67 for manually rotating it.

Next, the paper transporting route along which copy paper is transported to the transfer position of the photoreceptor 5 and from there to the various processing stations will be explained by way of FIGS. 5 and 11. As explained above, the synchronization rollers 10 are provided to the supporting frame 28, and the copy paper which is transported to them through feed rollers 87 and 89 is further transported to the transfer position of the photoreceptor 5 through a route defined by guiding plates 72 and 73. These guiding plates 72 and 73 are rotatably supported at one end respectively by axes 74 and 75 which are affixed to the supporting frame 28. The other ends of the guiding plates 72 and 73 are extended to the transfer position of the photoreceptor 5 as shown in FIG. 11. As shown in FIG. 12, however, the guiding plates 72 and 73 are adapted to hang in downward directions by their own weights. A plate spring 76 is provided for the purpose of keeping them in the positions shown in FIG. 11. One end of this plate spring 76 is affixed as shown in FIG. 12 to a supporting member 77 which supports the conveyor belt 16 and the air suction means described above, and the free end thereof supports the guiding plate 73. A protrusion 78 is unistructurally provided to the guiding plate 73 by means of which the other guiding plate 72 is maintained at the position shown in FIG. 11.

The aforementioned supporting member 77 is supported by the main body of the copying machine rotatably through an axis 79. In addition to the conveyor belt 16, the transfer corona discharger 9 and the AC corona discharger 11 are removably attached to this supporting member 77. The transfer corona discharger 9 and the AC corona discharger 11 are attached not too rigidly to the supporting member 77 such that they may vibrate in vertical directions. For the purpose of their positioning with respect to the photoreceptor 5, the insulative members for securing the corona discharge lines are formed so as to coincide with the shape of the supporting frame 28. If the supporting member 77 is positioned as shown in FIG. 11, therefore, the insulative members of the dischargers 9 and 11 come to be in contact with the supporting frame 28 and their positioning with respect to the photoreceptor 5 can be accomplished thereby. The supporting member 77 is upheld in the position shown in FIG. 11 by means of a supporting arm 81 which is rotatably supported by an axis 80.

The supporting arm 81 is provided with a rotatable roller 82 where it comes in contact with the support member 77, and also with a handle (not shown) for making it easily rotatable. The supporting arm 81 is connected through a connecting piece 83 to a paper transporting member 84. The ends of the connecting piece 83 are rotatably connected respectively to the supporting arm 81 and the paper transporting member 84. The paper transporting member 84 is rotatably attached to the main body of the copying machine and is provided with a guide plate 85 for transporting copy paper to the synchronization rollers 10 and trailing rollers 86 and 87 for transporting paper. Rollers 88 and 89 which correspond to the rollers 86 and 87, respectively, are mounted on the main body of the copying machine and serve to transmit the driving force. The roller 88 is further provided with another trailing roller 90 opposite to it and adapted to forward to the rollers 86 and 88 the paper delivered to it. The feed rollers 87 and 89 are located at the junction of the transportation routes of paper delivered by individual rollers and advance the paper to the synchronization rollers.

If jamming of paper takes place in the route or if it is desired to pull out the supporting frame 28, the supporting arm 81 is rotated in the counter-clockwise direction with reference to FIG. 11. When this is done, the supporting member 77 comes down in the clockwise direction around the axis 79 by its own weight as shown in FIG. 13 and this causes the paper transporting member 84 to rotate in the counter-clockwise direction through the connecting piece 83. The route in the paper transporting system is thus opened and the jammed paper can be easily disposed of.

When the supporting member 77 comes down as shown in FIG. 13, the guiding plates 72 and 73 for leading paper to the transfer position also hang down by their own weights until stopped by the stopper 91 provided on the guiding plate 72 as shown more in detail in FIG. 12 because the plate spring 76 no longer applies any force to them. This allows any paper in contact with the photoreceptor 5 to be removed.

The supporting frame 28 can be pulled out only under the condition shown in FIG. 13 after the supporting arm 81 is rotated in the counter-clockwise direction. This is so because a blocking means 92 is provided to the supporting member 77 for blocking the removal of the supporting frame 28. This blocking means 92 is secured to the supporting member 77 so as to be opposite to the supporting frame 28 in the situation depicted in FIG. 11. This means that the supporting frame 28 cannot be pulled out in the condition depicted in FIG. 11 because the blocking means 92 of the supporting member 77 is opposite to the supporting frame 28. When the supporting arm 81 is operated to open the paper transporting system, however, the blocking means 92 becomes released as shown in FIG. 13 from the position for preventing the supporting frame 28 from becoming pulled out.

When the supporting arm 81 is rotated in the clockwise direction, the supporting member 77 is raised and the guiding plates 72 and 73 are pushed up by the plate spring 76. The free ends of the guiding plates 72 and 73 are thus positioned near the image transferring position opposite to the photoreceptor 5. The positioning of the guiding plate 72 is effected by means of a positioning stopper 93.

Next, the cleaner unit 13 for removing the toner remaining on the photoreceptor 7 will be described. Reference being made to FIG. 11, the cleaner unit 13 has a cleaning blade 95 inside a housing 94 such that the end of the blade 95 is pressed against the surface of the photoreceptor 5 to remove the remaining toner. The cleaner unit 13, too, is removably mounted on the supporting frame 28. Thus, the supporting frame 28 is provided with cleaner guides **96*a* and 96*b* sandwiching the housing 94 as shown in FIG. 5 to assist the removal of the cleaner unit 13**.

As shown in FIG. 14, the housing 94 of the cleaner unit 13 is provided at the top with a pair of pins 97 secured to it and a number of holes. The cleaner guide **96*a* is provided with L-shaped grooves as shown in FIG. 15, corresponding to the pins 97. It is also provided with holes 100 for securing it with the housing 94** by screws.

When it is desired to remove the cleaner unit 13 from the supporting frame 28, all screws are removed first and the housing 94 is moved to the right with respect to the axis of the photoreceptor 5 and pulled forward.

Next, the method of replacing or cleaning the photoreceptor 5 is explained. The front door (not shown) on the main body of the copying machine is opened and the supporting arm 81 is turned in the counter-clockwise direction. The supporting member 77 and the paper transporting member 84 are also turned to open the paper transporting system. When the paper transporting system is in the opened condition, the supporting frame 28 can be pulled in the direction of the front door. The supporting frame 28 can be pulled out because, as explained above, the supporting member 77 is already open and the blocking means 92 is not in the position to prevent the opening. FIG. 2 shows how it looks when the supporting frame 28 is pulled out.

Next, the positioning lever 65 provided to the supporting frame 28 is rotated in the counter-clockwise direction. This causes the developing station 8 to move to the right as shown in FIG. 10 and to separate it further from the photoreceptor 5. When the screws or the like securing the supporting frame 28 with respect to the attaching means 29 of the photoreceptor 5 are removed in this condition, the attaching means 29 becomes rotatable around the axis 31. If it is turned in the counter-clockwise direction, the engaging member 44 becomes engaged with the engaging piece 48 as shown in FIG. 6.

When the attaching means 29 is opened as shown in FIG. 6, a portion of the surface of the photoreceptor 5 becomes exposed such that it becomes possible to clean the photoreceptor 5 while the attaching means 29 is attached to it. In this situation, the photoreceptor 5 must be rotated around its axis but this rotation can be effected by turning the manual knob 32.

When it is desired to replace the photoreceptor 5, the screw means 430 is removed in the condition depicted in FIG. 6 and the lever 43 is rotated in the clockwise direction. When this is done, the D-shaped cuts 40 on the axis 30 for supporting the photoreceptor 5 become aligned with the insertion entrance 42 and it becomes possible to dismantle the axis 30 from the attaching means 29 through the insertion entrance 42. The photoreceptor 5 which has been taken off the attachment means 29 can be disengaged from the axis 30 by removing the securing member 39 of FIG. 4 and pulling the flange 37 off the axis 30. The process described above should be reversed when a new photoreceptor is mounted.

Next, the developing station 8 will be described. Replacement of the developing station 8 is effected, for example, when it is desired to change the color of the toner. As explained above, the developing station 8 becomes separated from the photoreceptor 5 if the supporting frame 28 is pulled out and the positioning lever 65 is turned thereafter. Under this condition, the guide means 54 of the tank 51 becomes disengaged from the guide members 71 on the supporting frame 28. This enables the developing station 8 to be taken out in the outward direction.

When the developing station 8 is positioned as shown in FIG. 10, the developer roller 57 and the stirrer rollers 58 and 59 inside the tank 51 can be rotated by the knob 105 such that the developing agent becomes stirred and supplied to the developer roller 57. In short, the developer roller 57, etc. can be rotated manually according to the present invention while the developing station 8 is separated from the photoreceptor 5. This prevents the magnetic brush of the developing station 8 from applying the developer to the same area on the photoreceptor 5 while the latter is stationary and hence damaging the surface or applying an excessive amount of toner to one spot.

Positioning of the developing station 8 with respect to the developing position opposite to the photoreceptor 5 can be effected by rotating the positioning lever 65 in the clockwise direction with reference to FIG. 10 and thus moving the developing station 8 to the left by the axis 67. The collar 53 on the tank 51 contacts the photoreceptor 5 and the axis 50 engages with the positioning groove 55 such that the developing station 8 becomes correctly positioned, separated from the photoreceptor 5 by a fixed distance.

When jamming occurs in the paper route, the paper transporting system is opened as explained above by way of FIG. 13 and the jammed paper can be easily removed. Even if the jamming is caused by a sheet of paper firmly in contact with the photoreceptor 5, the guiding plates 72 and 73 drop by their own weights to remove the paper from the photoreceptor 5.

If it is made possible to pull out the supporting frame 28 as described above, there is the danger of inadvertently pulling it out when the paper route is jammed. If the supporting frame 28 is pulled while the paper route is jammed, the jammed paper may become torn and a part of it may remain in the route to damage the photoreceptor 5 or to cause further jamming of paper that comes after. In view of this possibility, the system according to this invention is so designed that the supporting frame 28 cannot be pulled out unless the paper route is opened up. This is so, as explained above, because the blocking means 92 on the supporting member 77 prevents it from being pulled out. When the paper route has been jammed, therefore, the supporting arm 81 must be turned before the supporting frame 28 is pulled out so that the paper route is opened and the jammed paper can be removed.

With respect to the paper transporting system, the supporting arm supporting the supporting member 77 is connected to the paper transporting member 84 for assisting the transportation of paper such that the supporting arm 81 can simultaneously release both the supporting member 77 and the paper transporting member 84. In other words, jammed paper can be easily disposed of because the entire paper transporting system can be opened by one operation. Moreover, since both the supporting member 77 and the paper transporting member 84 are opened and closed together, there is no danger of starting the copying operation with one of them inadvertently left in an open condition.

To summarize the present invention, the photoreceptor and the developing station of an electrophotographic copying machine are supported on a single supporting means which is removable in the direction of the axis of the photoreceptor and the paper route for transporting copy paper to the photoreceptor is made openable. The supporting means can be removed only when the paper route is opened so that jamming of paper in the paper route can be remedied easily.

The foregoing description of a preferred embodiment of the invention has been presented for purposes of illustration and description. It is not intended to be exhaustive or to limit the invention to the precise form disclosed, and obviously many modifications and variations are possible in light of the above teaching. Such modifications and variations which may be apparent to a person skilled in the art are intended to be included within the scope of this invention.

What is claimed is:

1. An electrophotographic copying machine comprising a recording medium rotatable around an axis, a developing station provided with stirring means for developing electrostatic latent images formed on said recording medium and motion-communicating means for communicating motion of an external power source to said stirring means, a housing which normally contains said recording medium and said developing station therein, and a supporting member supporting both said recording medium and said developing station and being slidable parallel to said axis to assume a pulled-out position outside said housing, said developing station being displaceable on said supporting member between a developing position where said developing station is proximal and opposite to said recording medium and a retracted position separated from said recording medium when said supporting member is in said pulled-out position, said supporting member having gear means mounted thereon which become engaged with said motion-communicating means of said developing station when said developing station is displaced on said supporting member to said retracted position, said developing station being so supported by said supporting member that said stirring means become manually operable only when said supporting member is at said pulled-out position and said developing station is at said retracted position.

* * * * *